United States Patent [19]

Mixon, Jr.

[11] Patent Number: 4,778,417

[45] Date of Patent: Oct. 18, 1988

[54] ADJUSTABLE TRANSOM

[76] Inventor: Perry J. Mixon, Jr., Rte. 1, Box 90, Riviera, Tex. 78379

[21] Appl. No.: 64,465

[22] Filed: Jun. 22, 1987

[51] Int. Cl.[4] ..... B63H 21/26

[52] U.S. Cl. ..... 440/61; 248/641; 440/900

[58] Field of Search ..... 440/53, 61, 63, 900; 248/640–643

[56] References Cited

U.S. PATENT DOCUMENTS 3,877,667 4/1975 Monckton ..... 248/641

4,089,290 5/1978 Miles, Sr. et al. ..... 440/61

4,232,627 11/1980 Glenn et al. ..... 440/61

4,373,921 2/1983 Hall et al. ..... 440/61

*Primary Examiner*—Sherman D. Basinger

*Assistant Examiner*—Edwin L. Swinehart

*Attorney, Agent, or Firm*—Leon Gilden

[57] ABSTRACT

An adjustable transom for supporting a motor on a power boat includes the use of hydraulic cylinders to raise or lower the transom. A further cylinder may be provided to tilt the motor and transom in a manner which allows a flared bottom portion of the motor to function as a trim tab.

1 Claim, 2 Drawing Sheets

ADJUSTABLE TRANSOM

BACKGROUND OF THE INVENTION

1. Field of the Invention

The present invention relates to adjustable supports, and more particularly pertains to a new and improved adjustable transom for supporting a motor on a power boat.

2. Description of the Prior Art

The use of hydraulic cylinders to raise and lower motors on power boats is well known in the prior art. In this regard, numerous patents have issued regarding outboard motor mounting arrangements, and many of these patents reflect the use of hydraulic cylinders to raise and lower motors fixedly pivotally secured upon the transom of a boat. A typical example of such a prior art patent is U.S. Pat. No. 4,449,945 which issued to A. Ferguson on May 22, 1984. This representative patent discloses a motor mounted upon a transom and being movably into a raised and lowered position by a plurality of remotely operated hydraulic cylinders. The retractable piston member associated with each of the cylinders is directly attached to the pivotally mounted motor, and this arrangement requires substantial design modifications to be made to each and every different type of motor so as to allow the cylinders to be attached thereto. As can be appreciated, in many cases this is a substantially expensive undertaking and accordingly, many boat owners are forced to dispense with the convenience of hydraulically operated lifting and lowering means.

As such, there appears to be a need for some type of power boat motor mounting assembly which would be inexpensive to manufacture, which could provide the convenience of hydraulic tilting and trimming, and which would be adaptable for use with virtually any type and design of motor and boat. In this respect, the present invention substantially addresses this need.

SUMMARY OF THE INVENTION

In view of the foregoing disadvantages inherent in the known types of power boat motor mounting arrangements now present in the prior art, the present invention provides an improved power boat motor mounting arrangement wherein a motor is designed to be mounted directly to a movable transom, and the movability of the transom is afforded through the use of a plurality of hydraulic cylinders which allows the motor to be moved concurrently with the transom to obtain desired trim, tilt and lift positions. As such, the general purpose of the present invention, which will be described subsequently in greater detail, is to provide a new and improved motor mounting arrangement which has all the advantages of the prior art power boat motor mounting arrangements and none of the disadvantages.

To attain this, the present invention comprises a secondary movable transom mountable to the fixed transom forming a part of a boat. The secondary transom is designed to have a power boat motor mounted thereto, and a pair of hydraulic cylinders can be used to move the transom upwardly and downwardly as desired, thus to effect a raising and lowering of the motor as needed. Additionally, a third hydraulic cylinder may be attached to a topmost portion of the secondary transom, and the secondary transom may then be pivotally mounted to its own movable support structure, whereby the third cylinder can effect desired trim and tilting movements to the motor independently of any operable movement of the first two mentioned cylinders.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limited as to the scope of the invention in any way.

It is therefore an object of the present invention to provide a new and improved power boat motor mounting arrangement which has all the advantages of the prior art power boat motor mounting arrangements and none of the disadvantages.

It is another object of the present invention to provide a new and improved power boat motor mounting arrangement which may be easily and efficiently manufactured and marketed.

It is a further object of the present invention to provide a new and improved power boat motor mounting arrangement which is of a durable and reliable construction.

An even further object of the present invention is to provide a new and improved power boat motor mounting arrangement which is susceptible of a low cost of manufacture with regard to both materials and labor, and which accordingly is then susceptible of low prices of sale to the consuming public, thereby making such power boat motor mounting arrangements economically available to the buying public.

Still yet another object of the present invention is to provide a new and improved power boat motor mounting arrangement which provides in the apparatuses and methods of the prior art some of the advantages thereof, while simultaneously overcoming some of the disadvantages normally associated therewith.

Still another object of the present invention is to provide a new and improved power boat motor mounting arrangement which includes the use of a secondary transom that is designed to support any size and shape of power boat motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
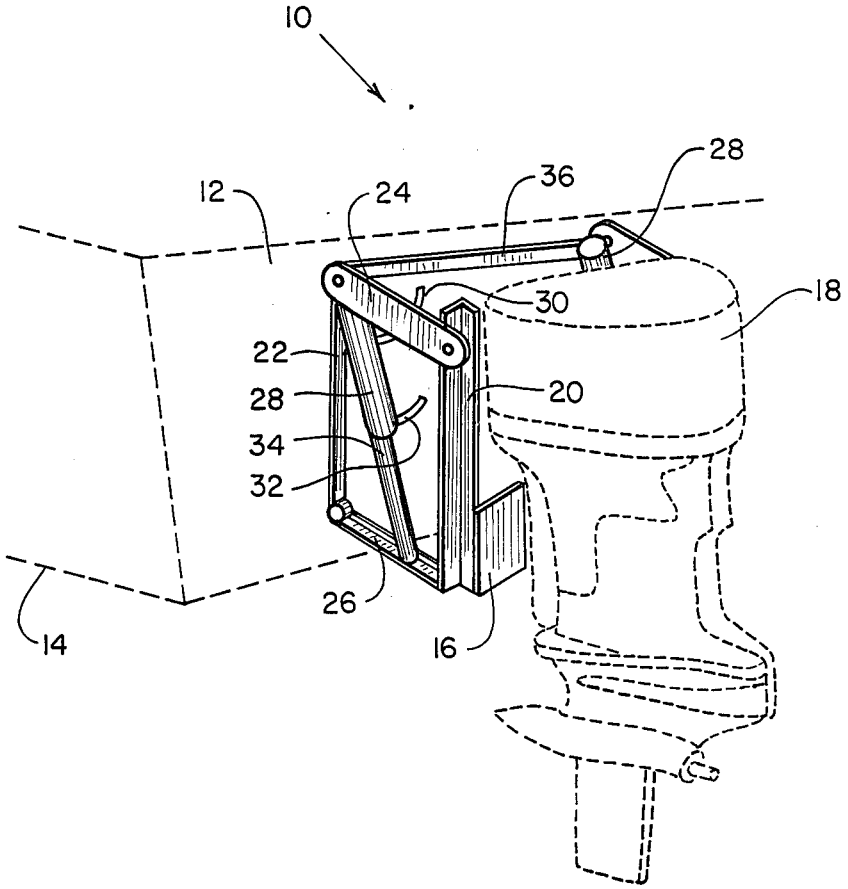
FIG. 1 is a perspective view of a first embodiment of the motor mounting arrangement comprising the present invention.

With reference now to the drawings, and in particular to FIG. 1 thereof, a first embodiment of a new and improved power boat motor mounting arrangement embodying the principles and concepts of the present invention and generally designated by the reference numeral 10 will be described.

More specifically, it will be noted that the first embodiment 10 of the invention is designed to be fixedly secured to the transom 12 of a power boat 14 and includes a secondary transom 16 to which a conventional motor 18 is conveniently mounted. It will be observed that only one half of the motor mounting assembly 10 is clearly depicted in FIG. 1; however, it is to be understood that the opposite side of the assembly—which is blocked from view by the motor 18—is identical in construction and design to the illustrated side. Accordingly, all discussion relating to the illustrated side of the invention 10 applies equally to the unillustrated side.

Continuing with reference to FIG. 1 then, it will be noted that the secondary transom 16 is supported by a pair of upstanding channel members 20, and such channel members are paralleledly aligned with and relatively movable with respect to further support members 22 fixedly secured to the transom 12 of the boat 14. In this regard, pairs of pivotally movable paralleledly aligned support members 24, 26 effect the desired connection between the members 20, 22, and pivotal connections are present at all connection points between the members 20, 22, 24, 26. In effect then, each side of the motor mounting arrangement 10 is defined by a plurality of members 20, 22, 24, 26 which are relatively movable with respect to one another and which define a parallelogram shape. More particularly, members 24, 26 will always be paralleledly aligned during any movement thereof, as will the members 20, 22.

Further illustrated in the drawing is a pair of conventional hydraulic cylinders 28 which facilitate a remote manual operation that accomplishes the desired relative movement between the members 20, 22, 24, 26. These hydraulic cylinders 28 include a fluid conduits 30, 32 which facilitate the extension and retraction of an operating piston 34 in a known manner. One end of each cylinder 28 is attached to a cross extending support member 36, with the opposed piston end then being attached to the outwardly extending support member 26.

As to the manner of usage and operation of this first embodiment 10 of the invention, it can be appreciated that this embodiment is particularly designed for raising and lowering a motor 18 which is attached to the movable transom 16. To effect a raising of the motor 18, fluid is delivered through the conduit 32 into the hydraulic cylinder 28 which then effects a retraction of the piston 34 into the cylinder housing. This causes the obvious upward movement of the secondary transom 16 to effect a raising of the motor 18 out of the water. Of course, an opposite flow of fluid through the conduits 30, 32 will effect a lowering of the motor 18.

Figure 2:
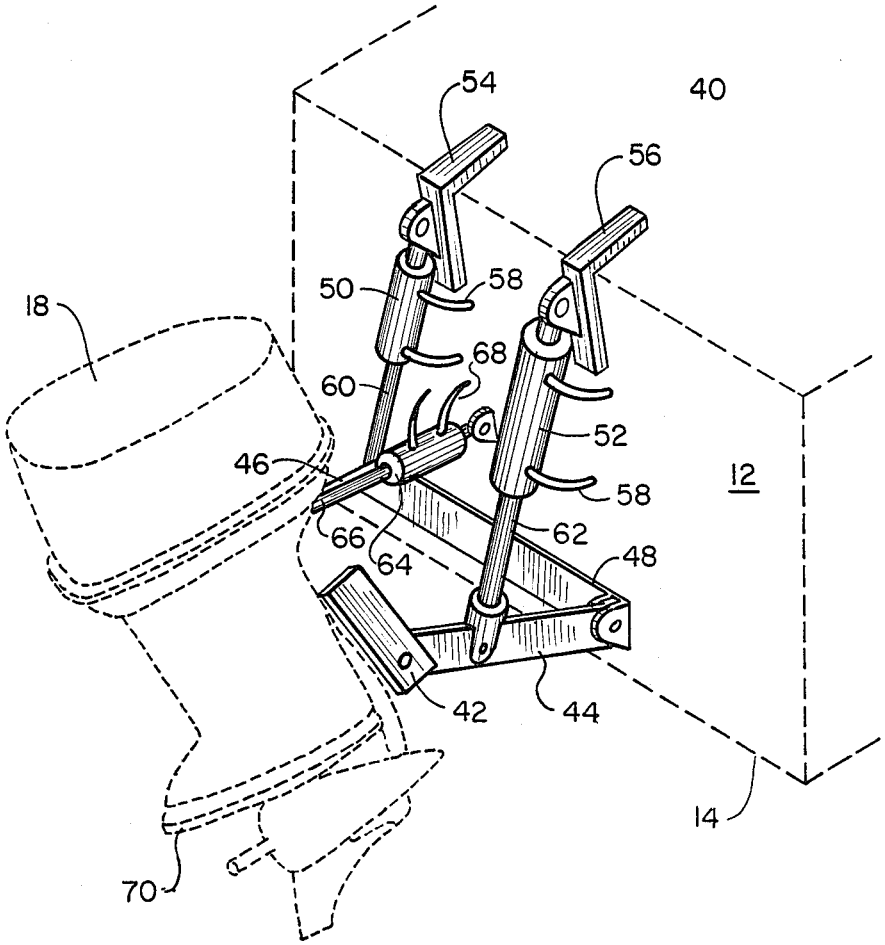
FIG. 2 is a perspective view of a second embodiment of the invention.

FIG. 2 of the drawings illustrates a modified embodiment of the invention which is generally designated by the reference numeral 40. The modified embodiment also includes a use of a secondary transom 42 which is pivotally mounted to a pair of outwardly extending support bar members 44, 46. The support bars 44, 46 are pivotally attached to a cross extending support bar 48 which is fixedly secured to the transom 12 of a power boat 14. As illustrated, a motor 18 is attached in a conventional manner to the secondary transom 42. A pair of hydraulic actuating cylinders 50, 52 are each respectively pivotally attached to a pair of L-shaped support members 54, 56, and these support members are in turn fixedly secured to the transom 12 of the boat 14. The hydraulic cylinders 50, 52 are both provided with conventional fluid delivery conduits which effect a desired operation thereof and which are all generally designated by the reference numeral 58. The piston members 60, 62 associated with the respective cylinders 50, 52 are each respectively pivotally attached to the outwardly extending support bars 46, 44.

Additionally, a third hydraulic cylinder 64 is pivotally attached to the transom 12 of the boat 14, and has its piston end 66 pivotally attached to the secondary transom 42. Appropriate fluid delivery lines 68 allow the desired remote operation of this third hydraulic cylinder 64 in the same manner as the fluid delivery lines 58 allow the remote operation of the hydraulic cylinders 50, 52.

As to the manner of usage and operation of the second embodiment 40 of the invention, it can be appreciated that various angles of tilt and trim for the motor 18 can be accomplished through the selective actuation of the three hydraulic cylinders 50, 52, 64. A raising and lowering of the motor 18 is accomplished by the actuation of the cylinders 50, 52. More specifically, a retraction of the piston members 60, 62 will cause the secondary transom 42 to move upwardly out of the water so as to raise the motor 18. A reverse extension of the piston members 60, 62 will cause the motor 18 to be lowered back into the water to a desired depth. By the same token, a retraction of the piston member 66 will cause the motor 18 to tilt forwardly towards the transom 12, thus to accomplish a further raising of the motor out of the water. A trim effect is achieved by an extension of the piston member 66 whereby the motor 18 is tilted rearwardly relative to the transom 12, and a bottom flared portion 70 of the motor will then function as a trim tab which effectively causes the stern of the boat 14 to plane upwardly out of the water. As such, this second embodiment 40 of the invention provides for motor tilting and trimming, as well as for a direct raising and lowering thereof.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved power boat motor mounting arrangement for attachment to a power boat transom comprising:

secondary transom means attached and being relatively movable to said transom of said power boat, said motor being attached to said secondary transom means; and said secondary transom means is pivotally attached to first ends of a first and second bar, said first bar spaced along said transom relative to said second bar with second ends of said first and second bar pivotally attached to a support bar secured to said transom, said first and second bar orthogonally pivotal with respect to said transom and a respective first and second hydraulic extensible and retractable cylinders respectively and pivotally attached between said first and second bars and said transom to effect pivoting of said first and second bars and said secondary transom to selectively raise and lower said motor relative to said power boat, and a third hydraulic extensible and retractable cylinder secured between said transom and said secondary transom to facilitate a tilting of said motor into a rearward position, whereby said motor operates as a trim device for said power boat, and said third hydraulic cylinder attached to said transom by a pivotal connection, said first and second hydraulic cylinders pivotally attached to respective "L"-shaped brackets with each "L"-shaped bracket securable to said transom.

* * * * *